US009506125B2

(12) United States Patent
Ueta et al.

(10) Patent No.: US 9,506,125 B2
(45) Date of Patent: Nov. 29, 2016

(54) AIRCRAFT ENGINE SHAFT COMPRISING A MARAGING STEEL HAVING A TENSILE STRENGTH OF 2300MPA OR MORE

(71) Applicants: Shigeki Ueta, Aichi (JP); Hiroyuki Takabayashi, Aichi (JP); Ei Kimura, Aichi (JP); Yuta Tanaka, Tokyo (JP); Satoshi Takahashi, Tokyo (JP); Isao Nakanowatari, Tokyo (JP); Kota Sasaki, Tokyo (JP); Koshiro Yamane, Tokyo (JP); Satoru Yusa, Tokyo (JP)

(72) Inventors: Shigeki Ueta, Aichi (JP); Hiroyuki Takabayashi, Aichi (JP); Ei Kimura, Aichi (JP); Yuta Tanaka, Tokyo (JP); Satoshi Takahashi, Tokyo (JP); Isao Nakanowatari, Tokyo (JP); Kota Sasaki, Tokyo (JP); Koshiro Yamane, Tokyo (JP); Satoru Yusa, Tokyo (JP)

(73) Assignees: DAIDO STEEL CO., LTD., Aichi (JP); IHI CORPORATION, Tokyo (JP)

( * ) Notice: Subject to any disclaimer, the term of this patent is extended or adjusted under 35 U.S.C. 154(b) by 33 days.

(21) Appl. No.: 13/910,313

(22) Filed: Jun. 5, 2013

(65) Prior Publication Data

US 2013/0327446 A1 Dec. 12, 2013

(30) Foreign Application Priority Data

Jun. 6, 2012 (JP) ..... 2012-128480
May 23, 2013 (JP) ..... 2013-108556

(51) Int. Cl.

| | |
|---|---|
| ***C22C 38/52*** | (2006.01) |
| ***C21D 6/00*** | (2006.01) |
| ***C22C 38/50*** | (2006.01) |
| ***C22C 38/44*** | (2006.01) |
| ***C22C 38/06*** | (2006.01) |
| ***C21D 6/04*** | (2006.01) |
| ***C21D 6/02*** | (2006.01) |
| ***C21D 7/13*** | (2006.01) |
| *C21D 1/25* | (2006.01) |

(52) U.S. Cl.

CPC ..... *C21D 6/004* (2013.01); *C21D 6/007* (2013.01); *C21D 6/02* (2013.01); *C21D 6/04* (2013.01); *C21D 7/13* (2013.01); *C22C 38/06* (2013.01); *C22C 38/44* (2013.01); *C22C 38/50* (2013.01); *C22C 38/52* (2013.01); *C21D 1/25* (2013.01)

(58) Field of Classification Search

CPC ..... C22C 38/52; C22C 38/06; C22C 38/44
USPC ..... 148/328
See application file for complete search history.

(56) References Cited

U.S. PATENT DOCUMENTS

| | | | | |
|---|---|---|---|---|
| 3,366,471 | A * | 1/1968 | Hill et al. | 420/8 |
| 3,585,011 | A * | 6/1971 | Matas et al. | 428/638 |
| 4,076,525 | A | 2/1978 | Little et al. | |
| 5,087,415 | A | 2/1992 | Hemphill et al. | |
| 5,393,488 | A * | 2/1995 | Rhoads et al. | 420/95 |
| 5,744,868 | A * | 4/1998 | Cozar et al. | 257/767 |
| 2008/0193321 | A1 | 8/2008 | Montagnon et al. | |

FOREIGN PATENT DOCUMENTS

| | | | |
|---|---|---|---|
| EP | 0390468 | 10/1990 | |
| FR | 2885141 | 11/2006 | |
| JP | 53-030916 | 3/1978 | |
| JP | 53030916 A * | 3/1978 | |
| JP | 2008304059 A * | 12/2008 | C22C 38/00 |
| JP | 2011-195922 | 10/2011 | |
| JP | 2011195922 A * | 10/2011 | |

OTHER PUBLICATIONS

English Machine Translation of JP 2008304059 A (Dec. 2008) of Bosch et al. is found at the end of Item N.*
Muktinutalapati Nageswara Rao, "Progress in understanding the metallurry of 18% nickel maraging steels", International Journal of Materials Research, Carl Hanser Verlag, Munchen, DE, vol. 97, No. 11, XP001519065 , Nov. 1, 2006, pp. 1594-1607.
Search report for EP Application No. 13 00 2915, mailed on Sep. 9, 2013.

* cited by examiner

*Primary Examiner* — Roy King
*Assistant Examiner* — Jophy S Koshy
(74) *Attorney, Agent, or Firm* — Greenblum & Bernstein, P.L.C.

(57) ABSTRACT

The present invention provides a maraging steel containing: $0.10 \leq C \leq 0.30$ mass %, $6.0 \leq Ni \leq 9.4$ mass %, $11.0 \leq Co \leq 20.0$ mass %, $1.0 \leq Mo \leq 6.0$ mass %, $2.0 \leq Cr \leq 6.0$ mass %, $0.5 \leq Al \leq 1.3$ mass %, and $Ti \leq 0.1$ mass %, with the balance being Fe and unavoidable impurities, and satisfying $1.00 \leq A \leq 1.08$, in which A is $0.95+0.35\times[C]-0.0092\times[Ni]+0.011\times[Co]-0.02\times[Cr]-0.001\times[Mo]$, where [C] indicates a content (mass %) of C, [Ni] indicates a content (mass %) of Ni, [Co] indicates a content (mass %) of Co, [Cr] indicates a content (mass %) of Cr, and [Mo] indicates a content (mass %) of Mo, respectively. The maraging steel has a tensile strength of 2,300 MPa or more and is also excellent in the toughness/ductility and fatigue characteristics.

2 Claims, No Drawings

AIRCRAFT ENGINE SHAFT COMPRISING A MARAGING STEEL HAVING A TENSILE STRENGTH OF 2300MPA OR MORE

FIELD OF THE INVENTION

The present invention relates to a maraging steel. More specifically, the present invention relates to a maraging steel which is excellent in the strength and toughness/ductility and is used for an engine shaft and the like.

BACKGROUND OF THE INVENTION

A maraging steel is a steel obtained by subjecting a non-carbon or low-carbon steel containing Ni, Co, Mo, Ti and the like in large amounts to solution heat treatment and quenching+aging treatment.

Maraging steels have the following characteristics:

(1) owing to formation of soft martensite in a quenched state, the machinability is good;

(2) owing to precipitation of an intermetallic compound such as $Ni_3Mo$, $Fe_2Mo$ and $Ni_3Ti$ in the martensite texture during the aging treatment, the strength is very high;

(3) despite high strength, the toughness/ductility is high.

Therefore, maraging steels are used, for example, in an aerospace/aircraft structural material (e.g., engine shaft), an automotive structural material, a high-pressure vessel or a tool material.

Conventionally, a 250 ksi (1,724 MPa) grade 18Ni maraging steel (Fe-18Ni-9Co-5Mo-0.5Ti-0.1Al) has been used for the aircraft engine shaft. However, with the recent desire to improve air pollution, such as tightening of exhaust gas regulations, it is required also for an aircraft to promote the efficiency. In view of engine design, the demand for a high-strength material capable of withstanding high output, downsizing and weight reduction is great.

With respect to such a high-strength material, various proposals have been heretofore made.

For example, Patent Document 1 discloses an ultra-high tensile strength and tough steel containing C: from 0.05 to 0.20 wt %, Si: 2.0 wt % or less, Mn: 3.0 wt % or less, Ni: from 4.1 to 9.5 wt %, Cr: from 2.1 to 8.0 wt %, Mo: from 0.1 to 4.5 wt % or Mo substituted partially or wholly with a double-volume of W, Al: from 0.2 to 2.0 wt %, and Cu: from 0.3 to 3.0 wt %, with the balance being iron and unavoidable impurities.

In this document, it is described that, by adding Cu and Al in combination to a low-carbon Ni—Cu—Mo steel, a strength of 150 kg/mm$^2$ (1471 MPa) or more is obtained without impairing toughness and weldability so much.

Also, Patent Document 2 discloses a high-strength, fatigue resistant steel, containing Ni: from about 10 to about 18 wt %, Co: from about 8 to about 16 wt %, Mo: from about 1 to about 5 wt %, Al: from about 0.5 to about 1.3 wt %, Cr: from about 1 to about 3 wt %, C: about 0.3 wt % or less, Ti: less than about 0.10 wt %, and a balance consisting of Fe and unavoidable impurities, wherein both a fine intermetallic compound and a carbide are precipitated.

In Table 2 of the same patent document, it is demonstrated that such a material has a tensile strength of 284 to 327 ksi (from 1,959 to 2,255 MPa) and an elongation of 7 to 15%.

A maraging steel is generally a high-strength material excellent in the toughness/ductility, but it is known to be difficult to secure toughness/ductility and fatigue resistance in a tensile strength region exceeding 2,000 MPa. Therefore, its application remains at a level that a 250 ksi grade 18Ni maraging steel is used as a general-purpose material.

On the other hand, the steels described in Patent Document 2 is also known as a high-grade general-purpose material. However, in order to meet the requirement for efficiency promotion or the like of an aircraft, it is necessary to more increase the strength (2,300 MPa or more) without causing reduction in the toughness/ductility and fatigue resistance.

[Patent Document 1] JP-A-53-30916 (the term "JP-A" as used herein means an "unexamined published Japanese patent application")

[Patent Document 2] U.S. Pat. No. 5,393,488

SUMMARY OF THE INVENTION

An object to be attained by the present invention is to provide a maraging steel having a tensile strength of 2,300 MPa or more and at the same time, being excellent in the toughness/ductility and fatigue characteristics.

Namely, the present invention provides a maraging steel comprising:

$0.10 \le C \le 0.30$ mass %, $6.0 \le Ni \le 9.4$ mass %, $11.0 \le Co \le 20.0$ mass %, $1.0 \le Mo \le 6.0$ mass %, $2.0 \le Cr \le 6.0$ mass %, $0.5 \le Al \le 1.3$ mass %, and $Ti \le 0.1$ mass %, with the balance being Fe and unavoidable impurities, and satisfying the following formula (1):

$$1.00 \le A \le 1.08 \quad (1)$$

wherein $A=0.95+0.35\times[C]-0.0092\times[Ni]+0.011\times[Co]-0.02\times[Cr]-0.001\times[Mo]$, in which [C] indicates a content (mass %) of C, [Ni] indicates a content (mass %) of Ni, [Co] indicates a content (mass %) of Co, [Cr] indicates a content (mass %) of Cr, and [Mo] indicates a content (mass %) of Mo, respectively.

When the ingredient ranges of main elements are limited to specific ranges and the contents of C, Ni, Co, Cr and Mo are optimized so as to satisfy the formula (1), a maraging steel having a tensile strength of 2,300 MPa or more and an elongation of 7% or more and at the same time, being excellent in the fatigue characteristics is obtained.

DETAILED DESCRIPTION OF THE INVENTION

One embodiment of the present invention is described in detail below.

[1. Maraging Steel]

[1.1. Main Constituent Elements]

The maraging steel according to the present invention contains the following elements, with the balance being Fe and unavoidable impurities. The kinds of additive elements, ingredient ranges thereof, and reasons for the limitations are as follows.

(1) $0.10 \le C \le 0.30$ mass %

C contributes to precipitating an Mo-containing carbide such as $Mo_2C$ and enhancing the base metal strength. Also, when an appropriate amount of carbide remains in the base metal, the γ particle size is kept from coarsening during the solution heat treatment. As the old γ particle size is smaller, finer martensite is formed, and higher strength and higher toughness/ductility are obtained. In order to obtain such an effect, the C content needs to be 0.10 mass % or more. The C content is preferably 0.15 mass % or more.

On the other hand, if the C content is excessive, an Mo-containing carbide is precipitated in a large amount and therefore, Mo for precipitating an intermetallic compound lacks. Also, a solution heat treatment at a higher temperature becomes required so as to dissolve the carbide, and this invites coarsening of the γ particle size. As a result, the optimal temperature range for suppressing coarsening of the γ particle size and dissolving the carbide becomes narrow, making the operation difficult. For this reason, the C content needs to be 0.30 mass % or less. The C content is preferably 0.25 mass % or less.

(2) 6.0≤Ni≤9.4 mass %

Ni contributes to precipitating an intermetallic compound such as $Ni_3Mo$ and NiAl and enhancing the base metal strength. In order to obtain such an effect, the Ni content needs to be 6.0 mass % or more. The Ni content is preferably 7.0 mass % or more.

On the other hand, if the Ni content is excessive, Mo is consumed to precipitate an excessive intermetallic compound, and the precipitation amount of Mo-containing carbide decreases. For this reason, the Ni content needs to be 9.4 mass % or less. The Ni content is preferably 9.0 mass % or less.

(3) 11.0≤Co≤20.0 mass %

Co is allowed to be dissolved in the host phase and thereby exerts an effect of accelerating precipitation of an intermetallic compound such as $Ni_3Mo$ and NiAl. In order to obtain such an effect, the Co content needs to be 11.0 mass % or more. The Co content is preferably 12.0 mass % or more, more preferably 14.0 mass % or more.

On the other hand, if the Co content is excessive, precipitation of an excessive intermetallic compound is too much accelerated, and the precipitation amount of Mo-containing carbide decreases. For this reason, the Co content needs to be 20.0 mass % or less. The Co content is preferably 18.0 mass % or less, more preferably 16.0 mass % or less.

(4) 1.0Mo≤6.0 mass %

Mo contributes to precipitating an intermetallic compound such as $Ni_3Mo$ and an Mo-containing carbide such as $Mo_2C$ and enhancing the base metal strength. In order to obtain such an effect, the Mo content needs to be 1.0 mass % or more. The Mo content is preferably 2.0 mass % or more.

On the other hand, if the Mo content is excessive, a heat treatment at a higher temperature is required so as to dissolve the carbide such as $Mo_2C$ precipitated during solidification, and this invites coarsening of the γ particle size. As a result, the optimal temperature range for suppressing coarsening of the γ particle size and dissolving the carbide becomes narrow, making the operation difficult. For this reason, the Mo content needs to be 6.0 mass % or less. The Mo content is preferably 5.0 mass % or less.

(5) 2.0≤Cr≤6.0 mass %

Cr contributes to improving the ductility. The reason why the ductility is improved by the addition of Cr is considered because Cr dissolves in an Mo-containing carbide and makes the carbide shape spherical. In order to obtain such an effect, the Cr content needs to be 2.0 mass % or more. The Cr content is preferably 2.5 mass % or more, more preferably 3.5 mass % or more.

On the other hand, if the Cr content is excessive, the strength is reduced. This is considered because the Mo-containing carbide is coarsened by the excessive addition of Cr. For this reason, the Cr content needs to be 6.0 mass % or less. The Cr content is preferably 5.0 mass % or less, more preferably 4.5 mass % or less.

(6) 0.5≤Al≤1.3 mass %

Al contributes to precipitating an intermetallic compound such as NiAl and enhancing the base metal strength. In order to obtain such an effect, the Al content needs to be 0.5 mass % or more. The Al content is preferably 0.7 mass % or more.

On the other hand, if the Al content is excessive, this element forms an oxide or a nitride, and the cleanliness is reduced. Also, if the dissolved amount of Al in the base metal is excessive, the toughness/ductility is reduced. For this reason, the Al content needs to be 1.3 mass % or less. The Al content is preferably 1.2 mass % or less.

(7) Ti≤0.1 mass %

Ti forms TiC, TiN and the like, thereby reducing the cleanliness. For this reason, the Ti content needs to be 0.1 mass % or less.

[1.2. Ingredient Balance]

In addition to the requirement that the ingredient elements are in the above-described ranges, the maraging steel according to the present invention needs to satisfy the following formula (1):

$$1.00 \leq A \leq 1.08 \quad (1)$$

wherein $A=0.95+0.35\times[C]-0.0092\times[Ni]+0.011\times[Co]-0.02\times[Cr]-0.001\times[Mo]$, in which (C) indicates a content (mass %) of C, [Ni] indicates a content (mass %) of Ni, [Co] indicates a content (mass %) of Co, [Cr] indicates a content (mass %) of Cr, and [Mo] indicates a content (mass %) of Mo, respectively.

Formula (1) is an empirical formula indicating the balance of respective ingredients necessary for obtaining a maraging steel having high strength and excellent toughness/ductility.

As the value A is larger, the tensile strength is more enhanced. In order to obtain a tensile strength exceeding 2,300 MPa, the value A needs to be 1.00 or more.

On the other hand, if the value A becomes too large, the elongation is reduced. In order to obtain an elongation of 7% or more, the value A needs to be 1.08 or less.

In this regard, with regard to each element contained in the steel of the present invention, according to an embodiment, the minimal amount thereof may be the amount in any one of the Examples as summarized in Table 1. According to a further embodiment, the maximum amount thereof may be the amount in any one of the Examples as summarized in Table 1. Furthermore, with regard to the value of A in the formula (1) regarding the steel of the present invention, according to an embodiment, the minimal value thereof may be the value in any one of the Examples as summarized in Table 1. According to a further embodiment, the maximum value thereof may be the value in any one of the Examples as summarized in Table 1.

[2. Production Method of Maraging Steel]

A method for producing the maraging steel according to the present invention includes a melting step, a re-melting step, a homogenization step, a forging step, a solution heat treatment step, a sub-zero treatment step, and an aging treatment step.

[2.1. Melting Step]

The melting step is a step of melting/casting raw materials blended to give predetermined ingredient ranges. The histories or melting/casting conditions of raw materials used are not particularly limited, and an optimal history or condition can be selected according to the purpose. In order to obtain a maraging steel excellent particularly in the strength and fatigue resistance, it is preferred to increase the cleanliness of the steel. To this end, melting of raw materials is preferably performed in a vacuum (for example, vacuum induction furnace melting method).

[2.2. Re-Melting Step]

The re-melting step is a step of again melting/casting an ingot obtained by the melting step. The re-melting step is not necessarily required, but by performing re-melting, the cleanliness of the steel is more improved and the fatigue resistance of the steel is enhanced. To this end, the re-melting is preferably performed in a vacuum (for example, vacuum arc re-melting method) and repeated a plurality of times.

[2.3. Homogenization Step]

The homogenization step is a step of heating the ingot obtained in the melting step or re-melting step at a predetermined temperature. The homogenizing heat treatment is performed so as to remove segregation produced during casting. The homogenizing heat treatment conditions are not particularly limited and may be conditions allowing for no solidification segregation. The homogenizing heat treatment conditions are usually a heating temperature of 1,150 to 1,350° C. and a heating period of 10 hours or more. The ingot after the homogenizing heat treatment is usually air-cooled or transferred in a still red-hot state to the next step.

[2.4. Forging Step]

The forging step is a step of forging the ingot after the homogenizing heat treatment and working it into a predetermined shape. The forging is usually performed by hot forging. The hot forging conditions are usually a heating temperature of 900 to 1,350° C., a heating period of 1 hour or more, and a finish temperature of 800° C. or more. The method for cooling after the hot forging is not particularly limited. The hot forging may be performed only once, or from 4 to 5 steps therefor may be performed continuously.

After the forging, annealing is performed, if desired. The annealing conditions are usually a heating temperature of 550 to 950° C., a heating period of 1 to 36 hours, and a cooling method of air cooling.

[2.5. Solution Heat Treatment Step]

The solution heat treatment step is a step of heating the steel worked into a predetermined shape, at a predetermined temperature. The solution heat treatment step is performed so as to make the base metal become a γ single phase and at the same time, to dissolve a precipitate such as Mo carbide. As for the solution heat treatment conditions, optimal conditions are selected according to the composition of the steel. The solution heat treatment conditions are usually a heating temperature of 900 to 1,200° C., a heating period of 1 to 10 hours, and a cooling method of air cooling (AC), air blast cooling (BC), water cooling (WC) or oil cooling (OC).

[2.6. Sub-Zero Treatment]

The sub-zero treatment is a step of cooling the steel after the solution heat treatment, to a temperature not more than room temperature. The sub-zero treatment is performed to transform the remaining γ phase to a martensite phase. The maraging steel is low in the Ms point and therefore, allows for remaining of a large amount of γ phase at the time of cooling to room temperature. Even if an aging treatment is performed in a state of a large amount of a γ phase still remaining, it cannot be expected that great enhancement of the strength is obtained. Therefore, the remaining γ phase should be transformed to a martensite phase by performing a sub-zero treatment after the solution heat treatment. The sub-zero treatment conditions are usually a cooling temperature of −197 to −73° C. and a cooling period of 1 to 10 hours.

[2.7. Aging Treatment]

The aging treatment is a step of heating the steel having produced therein a martensite phase, at a predetermined temperature. The aging treatment is performed to precipitate an intermetallic compound such as $Ni_3Mo$ and NiAl and a carbide such as $Mo_2C$. As for the aging treatment conditions, optimal conditions are selected according to the composition of the steel. The aging treatment conditions are usually an aging treatment temperature of 400 to 600° C., an aging treatment period of 0.5 to 24 hours, and a cooling method of air cooling.

[3. Action of Maraging Steel]

When the ingredient ranges of main elements are limited to specific ranges and the contents of C, Ni, Co, Cr and Mo are optimized so as to satisfy the formula (1), a maraging steel having a tensile strength of 2,300 MPa or more and an elongation of 7% or more and at the same time, being excellent in the fatigue characteristics is obtained. This is considered to result because by optimizing the ingredient elements, both an intermetallic compound and a carbide are precipitated in a balanced manner and the carbide establishes a fine and spherical morphology, making the old γ particle size become fine at the same time.

EXAMPLES

Examples 1 to 30 and Comparative Examples 1 to 17

1. Production of Sample

An alloy having the composition shown in Tables 1 and 2 was melted in a vacuum induction furnace to obtain 150 kg of an ingot. The obtained ingot was further re-melted in a vacuum arc melting furnace. The ingot after ingot making was subjected to a homogenizing heat treatment under the conditions of 1,250° C.×24 hours and air cooling, and then forged into a bar material having a diameter of 24 mm. The forging conditions were 1,250° C.×3 hours, finish temperature at 800° C. and air cooling. After the forging, annealing was performed under the conditions of 650° C.×8 hours and air cooling, and the bar was then roughly machined into a test piece for each test.

Subsequently, a solution heat treatment of the rough-machined test piece was performed under the conditions of 1,000° C.×1 hour and water quenching, and a sub-zero treatment of the rough-machined test piece was then performed under the conditions of −197° C.×1 hour. Furthermore, an aging treatment of the rough-machined test piece was performed under the conditions of 500° C.×5 hours and air cooling. Thereafter, each test piece was finish machined and then subjected to a tensile test, a Charpy impact test and a low cycle fatigue test.

TABLE 1

| | Composition (mass %) | | | | | | | | |
|---|---|---|---|---|---|---|---|---|---|
| | C | Ni | Co | Mo | Cr | Al | Ti | Fe | Value A |
| Example 1 | 0.12 | 7.7 | 16.0 | 2.2 | 2.6 | 0.8 | 0.02 | bal. | 1.04 |
| Example 2 | 0.17 | 9.0 | 16.0 | 3.0 | 4.0 | 0.9 | 0.02 | bal. | 1.02 |
| Example 3 | 0.22 | 8.5 | 16.0 | 2.8 | 3.8 | 1.0 | 0.03 | bal. | 1.05 |
| Example 4 | 0.28 | 7.9 | 15.0 | 3.3 | 2.7 | 0.9 | 0.01 | bal. | 1.08 |
| Example 5 | 0.18 | 6.5 | 17.0 | 2.9 | 4.3 | 0.9 | 0.02 | bal. | 1.05 |
| Example 6 | 0.19 | 7.9 | 13.0 | 3.1 | 3.3 | 1.0 | 0.03 | bal. | 1.02 |
| Example 7 | 0.22 | 8.6 | 13.0 | 2.9 | 2.8 | 0.8 | 0.01 | bal. | 1.03 |
| Example 8 | 0.20 | 9.4 | 14.0 | 3.1 | 2.9 | 0.8 | 0.02 | bal. | 1.03 |
| Example 9 | 0.25 | 7.2 | 11.0 | 3.5 | 3.1 | 1.2 | 0.03 | bal. | 1.03 |
| Example 10 | 0.24 | 7.0 | 12.0 | 2.5 | 4.0 | 0.7 | 0.02 | bal. | 1.02 |
| Example 11 | 0.23 | 7.9 | 13.0 | 2.9 | 3.2 | 0.9 | 0.01 | bal. | 1.03 |
| Example 12 | 0.22 | 8.1 | 15.0 | 2.7 | 2.9 | 1.3 | 0.02 | bal. | 1.06 |
| Example 13 | 0.21 | 8.2 | 17.0 | 3.3 | 3.0 | 1.0 | 0.03 | bal. | 1.07 |

TABLE 1-continued

| | Composition (mass %) | | | | | | | | |
|---|---|---|---|---|---|---|---|---|---|
| | C | Ni | Co | Mo | Cr | Al | Ti | Fe | Value A |
| Example 14 | 0.19 | 8.3 | 18.0 | 3.1 | 3.0 | 1.1 | 0.02 | bal. | 1.08 |
| Example 15 | 0.18 | 8.4 | 15.0 | 1.7 | 2.7 | 0.9 | 0.01 | bal. | 1.05 |
| Example 16 | 0.22 | 9.1 | 15.0 | 2.8 | 3.7 | 1.0 | 0.01 | bal. | 1.03 |
| Example 17 | 0.21 | 8.8 | 17.0 | 3.2 | 4.2 | 0.7 | 0.02 | bal. | 1.04 |
| Example 18 | 0.20 | 8.5 | 16.0 | 3.8 | 4.6 | 0.7 | 0.02 | bal. | 1.02 |
| Example 19 | 0.18 | 8.4 | 17.0 | 5.2 | 4.5 | 0.8 | 0.03 | bal. | 1.03 |
| Example 20 | 0.23 | 8.4 | 15.0 | 2.8 | 2.0 | 1.2 | 0.03 | bal. | 1.08 |
| Example 21 | 0.24 | 8.5 | 16.0 | 2.9 | 2.6 | 1.1 | 0.01 | bal. | 1.08 |
| Example 22 | 0.20 | 8.6 | 15.0 | 2.4 | 3.7 | 1.1 | 0.01 | bal. | 1.03 |
| Example 23 | 0.19 | 7.9 | 14.0 | 2.8 | 3.8 | 0.9 | 0.04 | bal. | 1.02 |
| Example 24 | 0.19 | 7.9 | 14.0 | 2.8 | 4.4 | 0.9 | 0.04 | bal. | 1.01 |
| Example 25 | 0.23 | 7.8 | 15.0 | 3.3 | 5.5 | 0.8 | 0.02 | bal. | 1.01 |
| Example 26 | 0.16 | 7.7 | 14.0 | 3.2 | 3.9 | 0.7 | 0.02 | bal. | 1.01 |
| Example 27 | 0.20 | 7.5 | 13.0 | 3.2 | 4.2 | 0.8 | 0.03 | bal. | 1.01 |
| Example 28 | 0.20 | 7.7 | 14.0 | 3.0 | 4.0 | 1.1 | 0.01 | bal. | 1.02 |
| Example 29 | 0.22 | 8.3 | 13.0 | 3.0 | 4.2 | 1.2 | 0.02 | bal. | 1.01 |
| Example 30 | 0.22 | 8.5 | 14.0 | 2.9 | 3.9 | 0.7 | 0.09 | bal. | 1.02 |

TABLE 2

| | Composition (mass %) | | | | | | | | |
|---|---|---|---|---|---|---|---|---|---|
| | C | Ni | Co | Mo | Cr | Al | Ti | Fe | Value A |
| Comparative Example 1 | 0.02 | 8.3 | 16.0 | 2.7 | 3.8 | 0.9 | 0.02 | bal. | 0.98 |
| Comparative Example 2 | 0.38 | 8.4 | 14.0 | 4.2 | 3.8 | 1.1 | 0.02 | bal. | 1.08 |
| Comparative Example 3 | 0.22 | 5.3 | 14.0 | 4.4 | 3.9 | 1.2 | 0.03 | bal. | 1.05 |
| Comparative Example 4 | 0.22 | 10.0 | 15.0 | 2.7 | 3.9 | 1.3 | 0.03 | bal. | 1.02 |
| Comparative Example 5 | 0.21 | 7.9 | 5.0 | 2.8 | 4.0 | 1.1 | 0.02 | bal. | 0.92 |
| Comparative Example 6 | 0.23 | 7.8 | 25.0 | 3.0 | 4.2 | 1.0 | 0.01 | bal. | 1.15 |
| Comparative Example 7 | 0.16 | 7.3 | 15.0 | 0.3 | 4.4 | 1.1 | 0.02 | bal. | 1.02 |
| Comparative Example 8 | 0.19 | 7.4 | 14.0 | 7.5 | 4.4 | 0.9 | 0.03 | bal. | 1.01 |
| Comparative Example 9 | 0.18 | 7.6 | 13.0 | 4.8 | 0.3 | 0.9 | 0.02 | bal. | 1.08 |
| Comparative Example 10 | 0.18 | 7.6 | 14.0 | 4.8 | 0.9 | 0.9 | 0.02 | bal. | 1.07 |
| Comparative Example 11 | 0.20 | 8.2 | 14.0 | 3.3 | 6.5 | 1.0 | 0.02 | bal. | 0.97 |
| Comparative Example 12 | 0.20 | 8.2 | 14.0 | 3.3 | 7.6 | 1.0 | 0.02 | bal. | 0.94 |
| Comparative Example 13 | 0.18 | 8.0 | 13.0 | 3.4 | 3.6 | 0.2 | 0.03 | bal. | 1.01 |
| Comparative Example 14 | 0.18 | 8.0 | 13.0 | 2.9 | 3.7 | 1.6 | 0.03 | bal. | 1.01 |
| Comparative Example 15 | 0.20 | 8.3 | 15.0 | 2.8 | 3.8 | 1.0 | 0.20 | bal. | 1.03 |
| Comparative Example 16 | 0.11 | 9.0 | 10.0 | 5.0 | 5.0 | 0.8 | 0.02 | bal. | 0.91 |
| Comparative Example 17 | 0.25 | 7.0 | 19.0 | 2.2 | 2.6 | 0.8 | 0.03 | bal. | 1.13 |

2. Test Method

[2.1. Crystal Grain Size]

The sample was collected from the transverse cross-section in the cogging direction, and corrosion of the old γ grain boundary was performed in 10% chromic acid by electric field corrosion. The crystal grain size was derived from the grain size number in accordance with JIS G 0551.

[2.2. Cleanliness]

The area ratio (%) of all inclusions was measured in accordance with the microscopic test method (JIS G 0555) by a point counting method for nonmetallic inclusions in the steel and taken as the cleanliness (d %) of the steel. In preparing the test piece, the bar material having a diameter of 24 mm after annealing was cut out into a length of about 10 mm, longitudinally broken in half, and embedded in a resin by arranging the longitudinal cross-section to serve as the test surface/observation surface, and the surface was mirror-polished.

[2.3. Rockwell Hardness]

The measurement was performed on the C scale in accordance with the Rockwell hardness test method (JIS Z 2245). The sample was collected from the cross-section in the cogging direction of the sample after the aging treatment and measured under a load of 150 kgf. As the measured value, an average value of 10 points was employed.

[2.4. Tensile Characteristics]

The tensile strength (MPa) was measured in accordance with the metal tensile test method (JIS Z 2241). As the test piece, a No. 14A test piece specified by JIS Z 2201 was employed. The test temperature was set to room temperature.

[2.5. Charpy Impact Test]

A test piece was collected such that the longitudinal direction of the test piece coincides with the cogging direction, and the test was performed on a 2 mm V-notched test piece (No. 5 test piece) in accordance with the JIS method (JIS Z 2242). The test temperature was set to room temperature.

[2.6. Low Cycle Fatigue Test (LCF)]

A test specimen material was collected such that the longitudinal direction of the test piece coincides with the cogging direction, and a test piece was produced in accordance with the JIS method (JIS Z 2279). Using this, the test was performed. The test temperature was set to 200° C. Also, the distorted waveform was set to a triangle, and frequency=0.5 Hz and distortion=0.9%.

3. Results

The results are shown in Tables 3 and 4. Tables 3 and 4 reveal the followings.

(1) When the amount of C is small, the toughness/ductility is high, but the hardness is low, and when the amount of C is excessive, the hardness is high but the toughness/ductility is poor. On the other hand, when the contents of other elements are optimized and at the same time, the amount of C is optimized, all of high hardness, high toughness/ductility and high fatigue resistance can be achieved.

(2) In a case where the content of one of Ni, Co, Mo and Al relating to the amounts of an intermetallic compound and a carbide precipitated is too small and a case where the content thereof is too large, the tensile strength is low. On the other hand, when the contents of other elements are optimized and at the same time, the content of these elements are optimized, all of high hardness, high toughness/ductility and high fatigue resistance can be achieved.

(3) When the amount of Cr is small, high strength is obtained but the toughness/ductility is low, and as the amount of Cr is increased, the toughness/ductility is enhanced, but when the amount of Cr becomes excessive, the strength and toughness/ductility are reduced. On the other hand, when the contents of other elements are optimized and at the same time, the amount of Cr is optimized, all of high hardness, high toughness/ductility and high fatigue resistance can be achieved.

(4) When the value A is low, the toughness/ductility is high but the strength is low, and as the value A is increased, the strength is enhanced, but when the value A becomes too high, the strength and toughness/ductility are reduced. On the other hand, when the contents of respective elements are optimized and at the same time, the value A is optimized, all of high hardness, high toughness/ductility and high fatigue resistance can be achieved.

TABLE 3

| | Number of Crystal Grain Size | Cleanliness | Hardness (HRC) | Tensile Test: Tensile Strength (MPa) | Tensile Test: Elongation (%) | Charpy Impact Test, Absorbed Energy (J) | LCF, Fracture Life $\times 10^4$ (cycle) |
|---|---|---|---|---|---|---|---|
| Example 1 | 3 | <0.01 | 60 | 2477 | 9 | 7 | >20 |
| Example 2 | 3 | <0.01 | 60 | 2466 | 11 | 9 | >20 |
| Example 3 | 3 | <0.01 | 61 | 2425 | 11 | 9 | >20 |
| Example 4 | 3 | <0.01 | 63 | 2442 | 8 | 9 | 18 |
| Example 5 | 3 | <0.01 | 60 | 2456 | 10 | 8 | >20 |
| Example 6 | 3 | <0.01 | 59 | 2455 | 11 | 9 | 19 |
| Example 7 | 3 | <0.01 | 61 | 2435 | 9 | 6 | >20 |
| Example 8 | 3 | <0.01 | 60 | 2412 | 10 | 8 | 19 |
| Example 9 | 3 | <0.01 | 61 | 2432 | 10 | 9 | 19 |
| Example 10 | 3 | <0.01 | 60 | 2408 | 11 | 9 | 18 |
| Example 11 | 3 | <0.01 | 61 | 2406 | 11 | 10 | >20 |
| Example 12 | 3 | <0.01 | 61 | 2433 | 10 | 9 | >20 |
| Example 13 | 3 | <0.01 | 62 | 2456 | 9 | 7 | 19 |
| Example 14 | 3 | <0.01 | 62 | 2415 | 10 | 8 | 18 |
| Example 15 | 3 | <0.01 | 60 | 2443 | 9 | 6 | >20 |
| Example 16 | 3 | <0.01 | 61 | 2435 | 11 | 9 | >20 |
| Example 17 | 3 | <0.01 | 61 | 2463 | 12 | 10 | >20 |
| Example 18 | 3 | <0.01 | 60 | 2427 | 10 | 9 | >20 |
| Example 19 | 3 | <0.01 | 61 | 2433 | 11 | 9 | >20 |
| Example 20 | 3 | <0.01 | 62 | 2419 | 7 | 6 | 18 |
| Example 21 | 3 | <0.01 | 63 | 2428 | 9 | 7 | 18 |
| Example 22 | 3 | <0.01 | 60 | 2437 | 11 | 10 | >20 |
| Example 23 | 3 | <0.01 | 59 | 2433 | 12 | 10 | 18 |
| Example 24 | 3 | <0.01 | 59 | 2424 | 11 | 9 | 17 |
| Example 25 | 3 | <0.01 | 59 | 2416 | 8 | 6 | 18 |
| Example 26 | 3 | <0.01 | 59 | 2428 | 11 | 10 | 18 |
| Example 27 | 3 | <0.01 | 59 | 2435 | 11 | 10 | 18 |
| Example 28 | 3 | <0.01 | 60 | 2437 | 12 | 10 | >20 |
| Example 29 | 3 | <0.01 | 60 | 2465 | 11 | 9 | 18 |
| Example 30 | 3 | <0.01 | 60 | 2444 | 11 | 9 | >20 |

TABLE 4

| | Number of Crystal Grain Size | Cleanliness | Hardness (HRC) | Tensile Test: Tensile Strength (MPa) | Tensile Test: Elongation (%) | Charpy Impact Test, Absorbed Energy (J) | LCF, Fracture Life $\times 10^4$ (cycle) |
|---|---|---|---|---|---|---|---|
| Comparative Example 1 | 0 | <0.01 | 55 | 2055 | 7 | 6 | 13.0 |
| Comparative Example 2 | 3 | <0.01 | 60 | 1999 | 0 | 1 | 2.5 |
| Comparative Example 3 | 3 | <0.01 | 52 | 1688 | 8 | 6 | 5.8 |
| Comparative Example 4 | 3 | <0.01 | 56 | 2078 | 8 | 5 | 13.0 |
| Comparative Example 5 | 3 | <0.01 | 56 | 1675 | 3 | 2 | 3.2 |
| Comparative Example 6 | 3 | <0.01 | 61 | 1877 | 0 | 0 | 0.4 |
| Comparative Example 7 | 0 | <0.01 | 58 | 2023 | 2 | 2 | 2.6 |
| Comparative Example 8 | 3 | <0.01 | 61 | 1787 | 9 | 8 | 8.7 |
| Comparative Example 9 | 3 | <0.01 | 59 | 2409 | 1 | 1 | 0.7 |
| Comparative Example 10 | 3 | <0.01 | 59 | 2409 | 5 | 4 | 11.0 |
| Comparative Example 11 | 3 | <0.01 | 58 | 2065 | 5 | 4 | 9.6 |
| Comparative Example 12 | 3 | <0.01 | 58 | 2065 | 1 | 1 | 0.8 |
| Comparative Example 13 | 3 | <0.01 | 59 | 1989 | 3 | 3 | 4.2 |

TABLE 4-continued

| | Number of Crystal Grain Size | Cleanliness | Hardness (HRC) | Tensile Test: Tensile Strength (MPa) | Tensile Test: Elongation (%) | Charpy Impact Test, Absorbed Energy (J) | LCF, Fracture Life $\times 10^4$ (cycle) |
|---|---|---|---|---|---|---|---|
| Comparative Example 14 | 3 | 0.05 | 59 | 2033 | 3 | 1 | 1.7 |
| Comparative Example 15 | 3 | 0.06 | 60 | 2415 | 8 | 6 | 1.8 |
| Comparative Example 16 | 3 | <0.01 | 56 | 2018 | 12 | 11 | 11.0 |
| Comparative Example 17 | 3 | <0.01 | 62 | 2066 | 1 | 9 | 4.5 |

While the mode for carrying out the present invention has been described in detail above, the present invention is not limited to these embodiments, and various changes and modifications can be made therein without departing from the purport of the present invention.

This application is based on Japanese patent application No. 2012-128480 filed Jun. 6, 2012 and Japanese patent application No. 2013-108556 filed May 23, 2013, the entire contents thereof being hereby incorporated by reference.

INDUSTRIAL APPLICABILITY

The maraging steel according to the present invention can be used for an aircraft engine shaft, a solid fuel rocket/motor/case, an aircraft lifting and lowering device, an engine/valve/spring (valve spring), a high strength bolt, a transmission shaft, a high-pressure vessel for petroleum/chemical industries, and the like.

What is claimed is:

1. An aircraft engine shaft comprising a maraging steel having a tensile strength of 2,300 MPa or more, an elongation of 7% or more, and a Low Cycle Fatigue (LCF) fracture life of $17\times10^4$ cycle or more, and comprising:

$0.10\leq C\leq 0.30$ mass %, $6.0\leq Ni\leq 9.4$ mass %, $11.0\leq Co\leq 20.0$ mass %, $1.0\leq Mo\leq 6.0$ mass %, $2.0\leq Cr\leq 6.0$ mass %, $0.5\leq Al\leq 1.3$ mass %, and $Ti\leq 0.1$ mass %, with the balance being Fe and unavoidable impurities, and satisfying the following formula (1):

$$1.00\leq A\leq 1.08 \quad (1)$$

wherein $A=0.95+0.35\times[C]-0.0092\times[Ni]+0.011\times[Co]-0.02\times[Cr]-0.001\times[Mo]$, in which [C] indicates a content of C in mass %, [Ni] indicates a content of Ni in mass %, [Co] indicates a content of Co in mass %, [Cr] indicates a content of Cr in mass %, and [Mo] indicates a content of Mo in mass %, respectively.

2. The aircraft engine shaft comprising a maraging steel as claimed in claim 1, wherein:

$2.5\leq Cr\leq 6.0$ mass %.

* * * * *